US005313885A

United States Patent [19]

Winston

[11] Patent Number: 5,313,885

[45] Date of Patent: May 24, 1994

[54] APPARATUS AND METHOD FOR A SEE THROUGH INK STAMP WITH DETACHABLE DIES

[76] Inventor: Jeffrey M. Winston, 658 W. Shore Dr., Anacortes, Wash. 98221

[21] Appl. No.: 925,810

[22] Filed: Aug. 4, 1992

Related U.S. Application Data

[63] Continuation of Ser. No. 840,628, Feb. 21, 1992, abandoned, which is a continuation of Ser. No. 481,557, Feb. 16, 1990, abandoned.

[51] Int. Cl.[5] ..... B41K 1/56

[52] U.S. Cl. ..... 101/405; 101/406

[58] Field of Search ..... 101/405, 406, 389.1

[56] References Cited

U.S. PATENT DOCUMENTS 2,819,668 2/1955 McAneny .
3,096,713 7/1963 McLaughlin, Jr. ..... 101/405
3,259,063 7/1966 Rothman .
3,403,623 10/1968 Blackwood .
3,973,495 8/1976 Rowe .
4,221,164 9/1980 Krulwich ..... 101/405

OTHER PUBLICATIONS

Marking Industry, May 1991, pp. 16, 20, 21, 22, 23.
Rubber Stamp Madness, May 1991, Issue 57, vol. 12, p. 49.

*Primary Examiner*—Edgar S. Burr
*Assistant Examiner*—John S. Hilten
*Attorney, Agent, or Firm*—Hughes & Multer

[57] ABSTRACT

A hand held apparatus for stamping ink images on paper, comprising a handle, which is substantially transparent, a printing die, which is able to bold ink on a printing surface thereof, and an attachment means by which said printing die is able to be detachably attached to the handle. The printing surface comprises a resilient, opaque substance, such as natural rubber.

10 Claims, 5 Drawing Sheets

APPARATUS AND METHOD FOR A SEE THROUGH INK STAMP WITH DETACHABLE DIES

This is a continuation of Ser. No. 07/840,628 filed on Feb. 21, 1992, now abandoned, which is a continuation of copending application(s) Ser. No. 07/581,557 filed on Feb. 16, 1990, now abandoned.

BACKGROUND OF THE INVENTION

1. Technical Field

The present invention relates generally to apparatus and methods for ink stamps, and more particularly to hand held ink stamps.

2. Background Art

Traditional hand held ink stamps typically comprise a varnished wood handle to which is fixedly attached a printing die, which traditionally is made of natural rubber. The person using the ink stamp makes the image simply by inking the printing die and pressing the printing die against a sheet of paper. The handle obstructs the user's view of the image that is being stamped, because the handle covers up the image.

In the ink stamping art, there are several needs.

First, there is a need for the person using the ink stamp to be able to see through a handle or a die mounting device, so that the user is able to view simultaneously both the page and the image that is about to be printed on the page. In the field of art stamping, i.e., where the quality of the stamping is important (as in stamping pictures and other artwork), the see-through capability raises the quality of the finished product by improving the accuracy with which images are Positioned on the page.

Second, there is a need for the printing dies to be readily attachable to, and detachable from the mounting device, so as to provide cost savings.

Third, there is a need to combine both the see-through capability and the detachability of the printing dies, with an ability to use the traditional natural rubber dies. The natural rubber dies have advantages over other types of dies such as plastic and photo-polymer dies including the fact that the natural rubber dies are typically more durable. Desirably the above described combination of features should be provided in an apparatus that is practical, versatile, and convenient to use.

SUMMARY OF THE INVENTION

A hand held apparatus for stamping ink images on paper, comprises a handle, a printing die, and attachment means, by which the printing die is able to be detachably attached to the handle. The handle is substantially transparent.

In a preferred embodiment, the printing die detachably attaches to a lower portion of the handle, whereby a person using the apparatus is able, through the transparent handle to see both the paper and a position of the printing die with respect to the paper. The upper portion of the printing die bears image position markings which correspond to said image. The image position markings, and also a configuration of a perimeter of the printing die, indicates to the person using the apparatus a position of said image with respect to the paper, In one embodiment, the attachment means comprises a magnetic means which magnetically connects the printing die to the handle. In another embodiment, a lower surface of the handle and an upper surface of the printing die both comprise smooth surfaces whereby the smooth surfaces adhere to one another. In the additional embodiment, an adhesion enhancing agent is able to be applied between the handle and the die.

DESCRIPTION OF THE PREFERRED EMBODIMENT

It is believed a better understanding Of the present invention which is an ink stamp 10 will be provided by first describing how the ink stamp operates as a basic ink stamp that prints ink images on a piece of paper. Next there will be a description of a first embodiment including magnetic attachment means for detachably connecting a printing die to a handle of the ink stamp 10, which will be followed by an explanation of a see-through characteristic of the first embodiment that enables a person's seeing through a mounting device of the ink stamp 10 so as to view the image that is being made on the paper. Later, alternative embodiments for detachably attaching the printing die to the handle using adhesives will be given, followed by further details of the invention.

1. Operation As a Basic Ink Stamp

Figure 1:
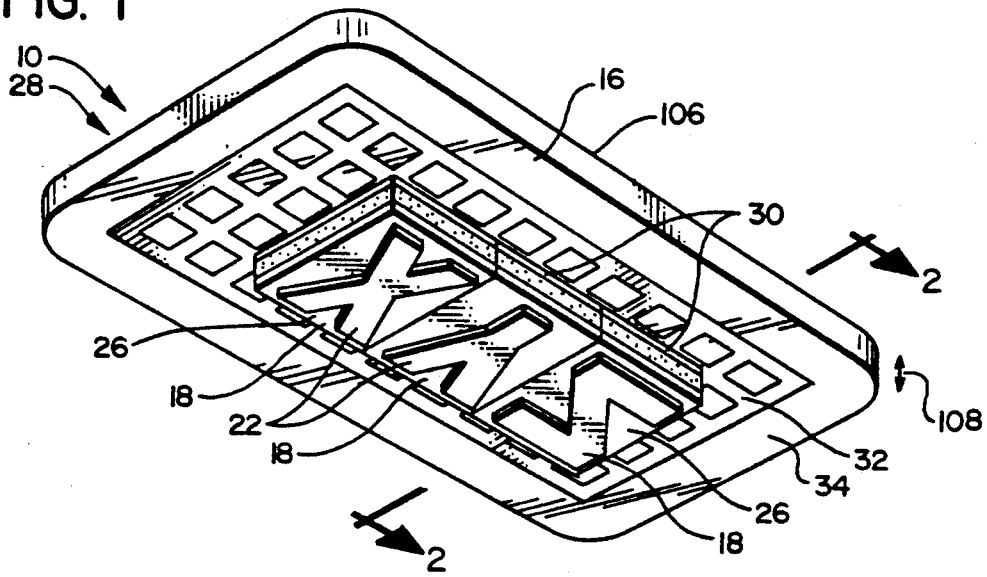
FIG. 1 is a perspective view from underneath of a first embodiment of the present invention.
Figure 2:
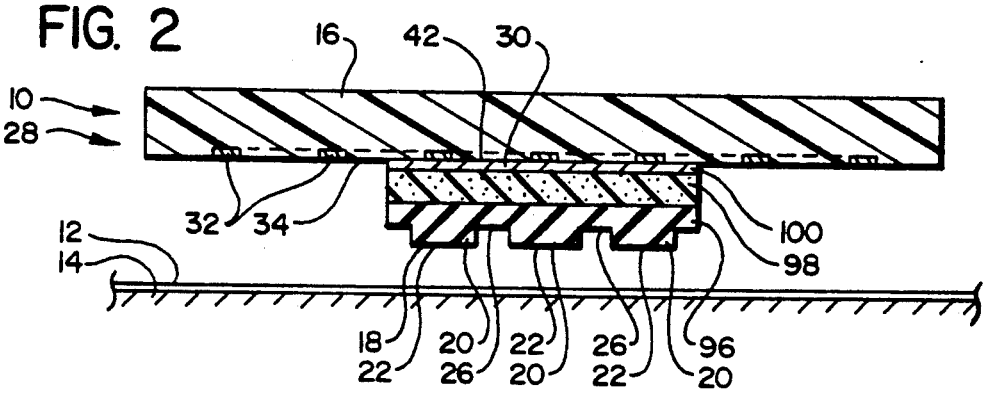
FIG. 2 is a section taken along the line 2—2 in FIG. 1, also showing a table-supported piece of paper on which an ink impression is made.

As shown in the perspective view from underneath of FIG. 1 and also in the section view of FIG. 2, the ink stamp 10 is able to be held by a person in the hand and is used to make printed ink impressions on a sheet of paper 12 which lies flat on an underlying table surface 14. The ink stamp 10 comprises a mounting device or handle 16 and one or more printing dies 18. As shown in the perspective view of the printing die of FIG. 3, the die 18 has a protruding ink-holding portion 20 which presents a printing surface 22 that is cut into the shape of an image, in this case an image 24 shown in FIG. 4 of a capital letter Z which is desired to be printed on the sheet of paper. The die 18 also has recessed portions 26 which do not reach to the paper 12 so as to leave an image. Once the printing surface 22 is loaded with ink, as from an ink pad (not shown), the user is able by grasping the handle 16 and by pressing the printing surface 22 against the paper 12 to print the image on the paper. Repeated images are able to be made on the paper simply by re-inking the printing surface and repositioning the printing surface to another part of the paper where the printing surface is again pressed against the paper.

2. A First Embodiment With Magnetic Attachment Means

In a first embodiment 28 the handle 16 and the die 18 are attached to one another by a suitable quick disconnecting attachment means, which is illustrated as a magnetic means. The die 18 comprises a magnet 30. As shown in FIG. 1 the handle 16 bas an iron screen 32 which extends across substantially all of a lower surface 34 of the handle. This iron screen is set into the lower surface 34.

The magnetization or adhering force of the magnet 30 within the die 18 is sufficiently strong that when the magnet is brought into contact with the iron screen 32 of the handle 16, the die 18 becomes firmly attached to the handle. The magnetization is sufficiently weak that the user is able comfortably to detach the die from the handle.

3. See-through Characteristic

Figure 7:
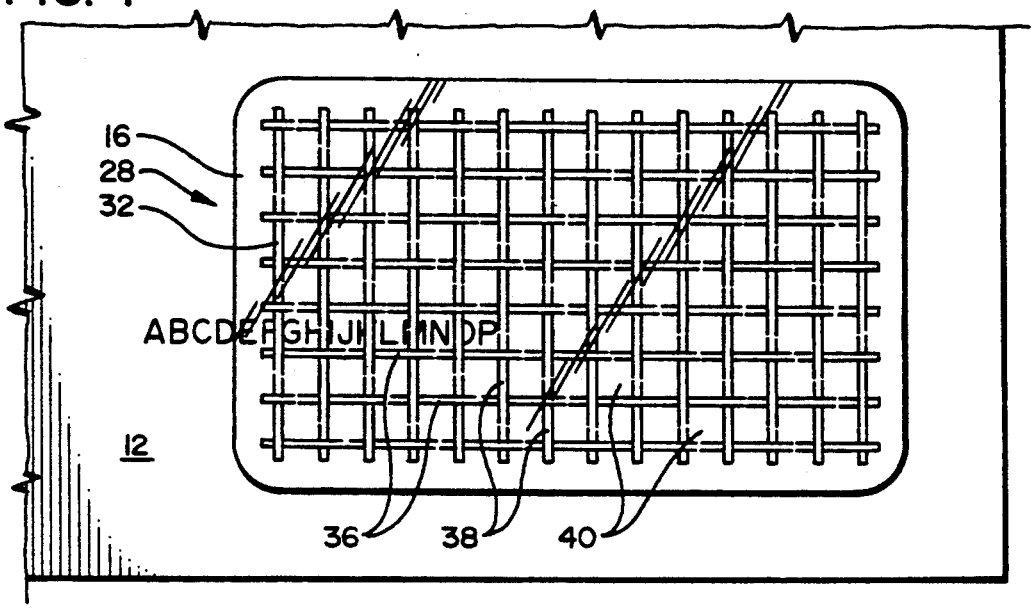
FIG. 7 is a view looking down on the handle, without the printing dies, resting on a piece of paper with writing thereon.

The handle 16 comprises a block of transparent material which the person using the ink stamp is able to see through. As shown in the view looking down on a paper and handle without the die)of FIG. 7, the iron screen 32 which as just mentioned is inlaid into the lower surface of the handle 16, comprises thin lengthwise strips 36 and crosswise strips 38 of iron that are arranged so that large holes 40 are left in the iron screen, whereby the user is easily able to see underneath the iron screen. As illustrated in FIG. 7, a person looking down on the handle is able to see most of the letters "ABCDEFGBIJKLMNOP" which are written on the surface of the paper 12 on which the handle 16 in the picture rests.

Figure 3:
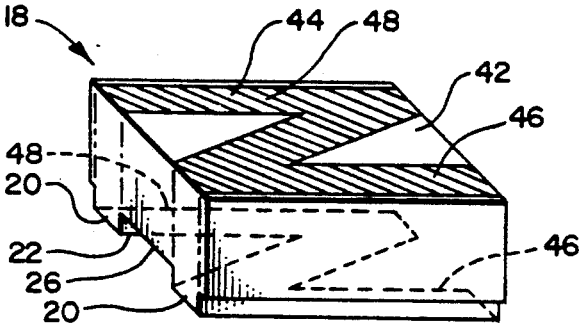
FIG. 3 is an enlarged schematic perspective view of a detachable printing die of the invention.
Figure 4:
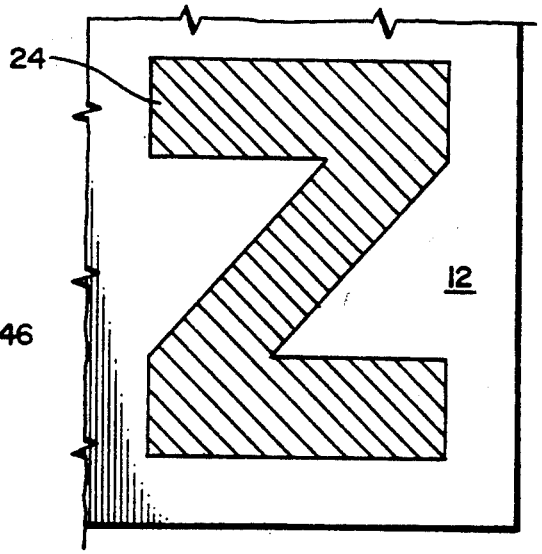
FIG. 4 illustrates the ink image that is made on the paper by the printing die of FIG. 3.
Figure 5:
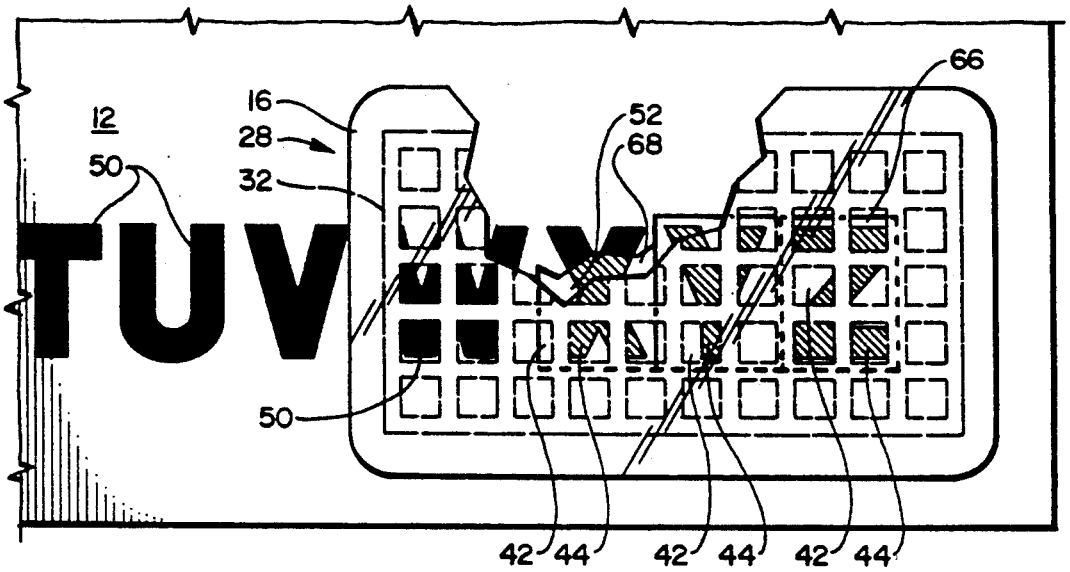
FIG. 5 is a view looking down on a piece of paper on which the present invention rests, with three of the printing dies being visible through a transparent handle and with portions of the handle and of the printing dies removed for ease of illustration.

It is important to the see-through feature of the present invention, that the person looking down on the handle is able to see not only the markings such as the ABCDEFGHIJKLMNOP on the underlying sheet of paper, but is also able to see the backs of the dies 18 themselves. In particular as shown in FIG. 5, the user looking down through the transparent handle 16 is able to see an upper surface 42 of each of the dies 18. As shown in FIG. 3, the upper surface 42 of each die bears image location markings 44. The position of each image location marking 44 on a die is directly above the position of its corresponding image. Tn the example pictured in FIG. 3, the letter Z's bottom bar 46 for the image location marking 44 is directly above the Z's bottom bar for the printing surface 22. Similarly, the Z's top bar 48 for the upper surface 42 is directly above the corresponding portion of the Z for the printing surface 22.

Returning to FIG. 5, the person simply by looking down through the handle 16 is able to see both markings 50 on the sheet of paper and the image location markings 44 of the image that is about to be made, so that prior to making the impression on the paper the person is able to see where the image will be positioned on the paper. In the example pictured in FIG. 5 where the ink stamp 10 rests on the printed page and where portions of the handle 16 and the X die 52 have been removed for ease of illustration, the see-through feature enables the user quite easily to position the image of the XYZ which is presently being made by the ink stamp, at a visually pleasing location in relation to the letters TUVW which were previously marked on the paper.

Figure 9:
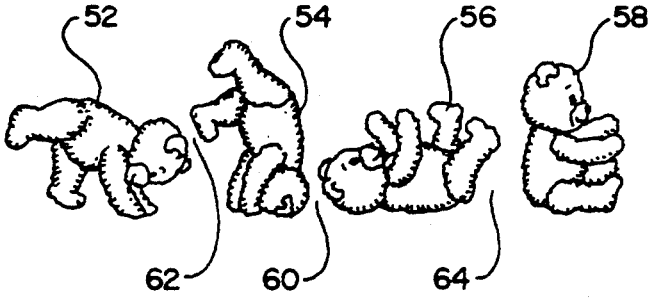
FIG. 9 is an illustration of multiple ink images, in this case bears in different positions, with each image produced by a different die.

In fact, the see-through feature aids the user in positioning a wide variety of images at visually appropriate or pleasing locations on the page. Another example is shown in FIG. 9. To make the display in this case, four individual dies 18, are used with each die having a different image, namely, a first image 52 of a bear on its paws? a second image 54 of the bear standing on its head, a third image 56 of the bear on its back, and a fourth image 58 of the bear sitting upright. The person will make the pictured display (of the four bears somersaulting) in the following manner. The person will assemble the dies for the first, second, and third images 52, 54, 56 on the handle 16. (Let us assume that the handle in this case accommodates three of the dies 18 at once). By looking through the transparent handle 16 and observing the image location markings 44, the person will be able to move the dies 18 around on the lower surface 34 of the handle and thereby to position the images in the desired relationship to one another. More particularly, the second image 54 of the bear standing on its head will be positioned so that it touches at 60 the third image 56 of the bear on its back, while the first image 52 of the bear on its paws will be spaced by a small amount at 62 leftwardly of the second image 54 of the bear on its head. After this configuration of dies has been assembled and after the images have been stamped on the page, the person will then remove the three dies from the handle and will attach to the handle a fourth die for the fourth image 58 of the bear sitting. Then, by viewing both the image that has already been stamped on the paper and the image location marking 44 which is visible on the back of the die for the fourth image 58 through the transparent handle, the person will position the fourth image at a location spaced slightly at 64 to the right of the previously stamped images and will then print the fourth image, thereby completing the display of the four bears somersaulting.

The interrelated images 52, 54, 56, and 58, are positioned in a visually appropriate relationship to one another. The registration of the images is controlled accurately.

4. Recapitulation

To recapitulate the description so far of the first embodiment 28, first the handle 16 and the dies 18 are detachably attached to one another by a quick disconnecting means which is illustrated in the first embodiment as a magnetic means, whereby the dies that are used with the handle 16 are able to be readily changed. Second, the user is able to see through the handle so that the person can view simultaneously the existing markings on the sheet of paper 12 and the image location markings of the upper surface or back 42 of the die.

It does not matter if the dies themselves are opaque. The invention is designed to provide substantial see-through capability with opaque dies. Consequently, the printing surface 22 of the dies 18 is able to be made of natural rubber, which, as mentioned in the Background Art section above, is the traditional material of which stamp elements are made.

5. Ability To Reposition the Dies on the Handle

The total useable area of the lower surface 34 of the handle preferably is sufficiently large to accommodate perhaps at least three to six dies at once.

Figure 6:
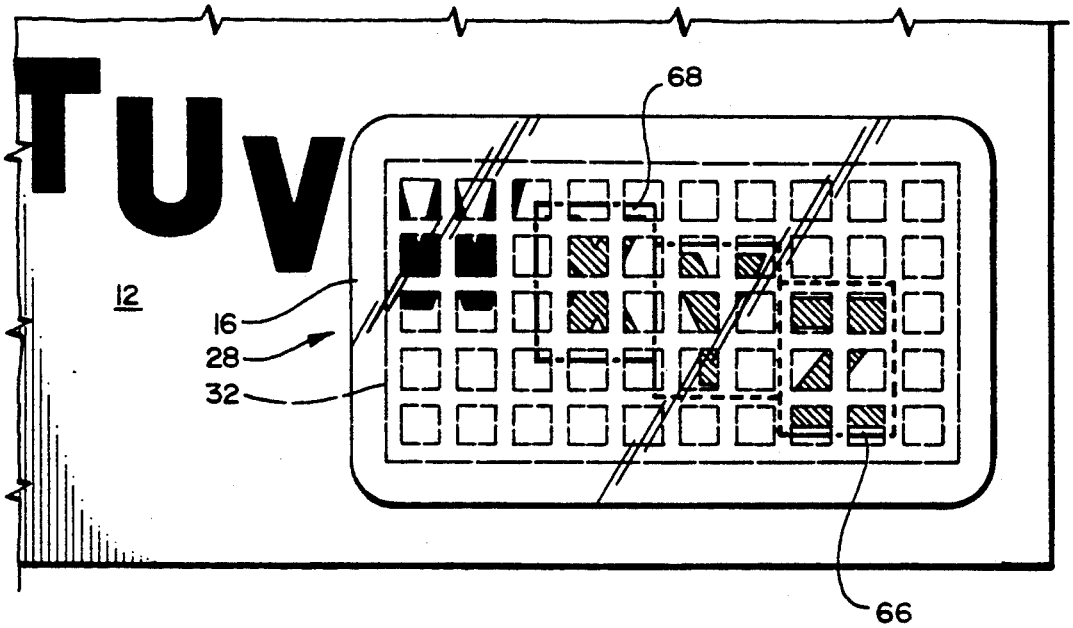
FIG. 6 is a view like FIG. 5, but without the portions of the apparatus being removed.

Due to the ability of the die to be easily attached and detached, the dies are able to be moved to various locations on the lower surface 34. For example#a die 66 for printing the letter Z, which is shown in FIG. 5 positioned on the handle 16 in a first middle position, is readily able to be detached from the handle and reattached as shown in FIG. 6 to a second lower position on the handle 16. Similarly, a die 68 for printing the letter X, which in FIG. 5 is in a third middle position, is able to be reattached easily to the handle as in FIG. 6 at a fourth upper position on the handle. Also various different dies or combinations thereof are able to be selected quickly from a set of dies and assembled on the handle 16. The changes of the dies are able to be done quickly.

6. A Second Embodiment Using a Naturally Adhesive Bonding Surface

Figure 10:
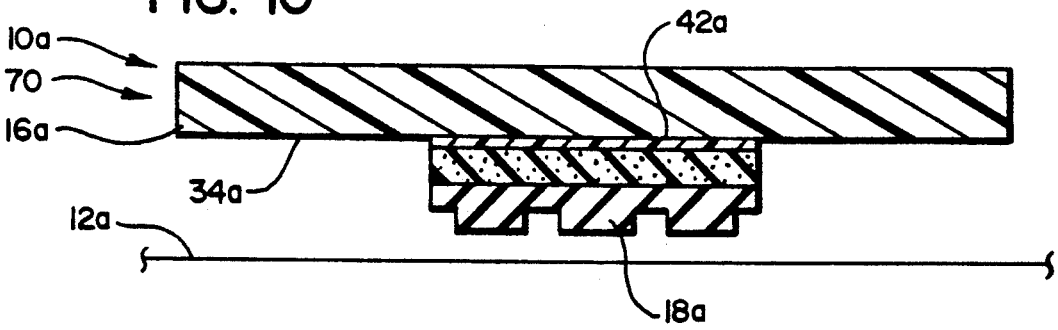
FIG. 10 is a section view like FIG. 2, but illustrating a second embodiment of the invention that uses naturally adhering surfaces to temporarily bond the printing dies to the handle.

In a second embodiment 70, in which components that are similar to components of the first embodiment will have the same numerical designations but with the small letter 'a' added and which is shown in the section view of FIG. 10, the ink stamp **10*a* comprises, as before, the handle 16*a* and the die 18*a*. However, unlike in the first embodiment, there is no iron screen in the handle 16*a* and there is no magnet in the die 18. The adhering surfaces, that is to say, the lower surface 34*a* of the handle, and the upper surface 42*a*** of the die, comprise a first material, such as for example acrylic plexiglass, and a second material, such as for example hand held stretch film marketed under the name Saran Wrap, respectively, that naturally adhere to one another when they are brought into contact. Again, as in the first embodiment, the adhesive force between the handle and the die, once they are brought together, is strong enough to attach the die to the handle firmly for purposes of printing, but weak and temporary enough to enable the die to be readily removed from the handle when desired.

In other respects, the second embodiment is the same as the first embodiment. The handle **16*a* is transparent. The paper 12*a* on which the printing is to be done, and the position of the image (as indicated by image location markings, which are not shown in FIG. 10, on the back of the die 18*a*) are able to be seen by the person through the handle 16*a***, so that prior to printing, the user can see where the image will be positioned.

7. A Third Embodiment Using an Innocuous Liquid as an Adhesion Enhancing Agent

Figure 12:
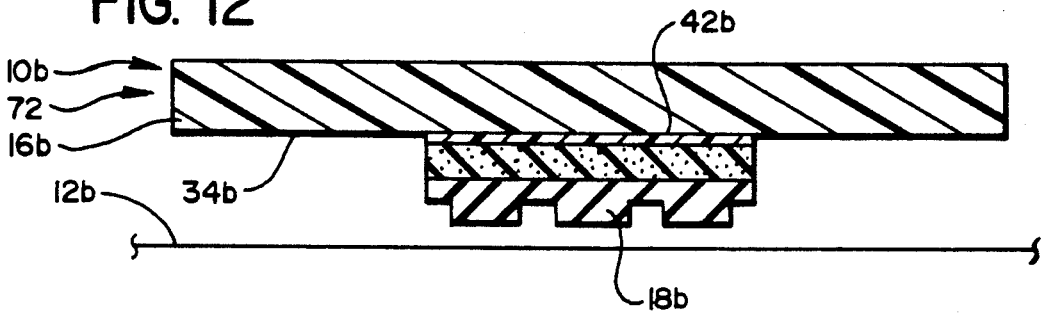
FIG. 12 is a view like FIG. 10, but illustrating a third embodiment in which water is applied to the bonding surfaces of the handle and the die.

A third embodiment 72, which is illustrated in FIG. 12 wherein components that are like those of the previous embodiments have the same numerical designations, but with the small letter 'b' as a suffix, is like the second embodiment, except that the adhering surfaces **34*b* and 42*b*** of the handle and of the die are such that prewetting them with an innocuous liquid, such as water, enhances the adhesion between them. This adhesion enhancement effect is the same as observed for example with plastic bathtub toys. When a smooth surface of the plastic bathtub toy is wetted and placed against the smooth surface of the bathtub, the wetted surface of the plastic toy adheres to the surface of the bathtub rather firmly.

As shown in FIG. 12, the ink stamp **10*b* again comprises the handle 16*b* and the die 18*b*. The user wets the lower surface 34*b* of the handle and the upper surface 46*b* of the die, which are both smooth, prior to bringing the handle and the die together. The surfaces 34*b* and 42*b***, which function like the smooth surface of the plastic toy and of the bathtub just described will bond temporarily due to the adhesion between the surfaces, while the ink stamp meanwhile is being used. Afterwards, the die can be removed by pulling it free from the handle.

Figure 11:
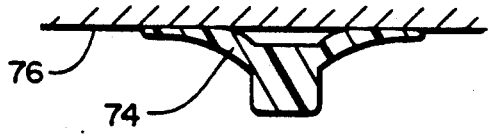
FIG. 11 is a schematic section of a wetted suction cup adhering to a flat surface.

(A similar adhesion enhancement effect is observed sometimes with wetted rubber cups 74 as shown in FIG. 11. The suction cup, it is observed, when wetted will adhere better to a smooth surface then when dry.)

8. A Fourth Embodiment Using a Temporary Adhesive

Figure 13:
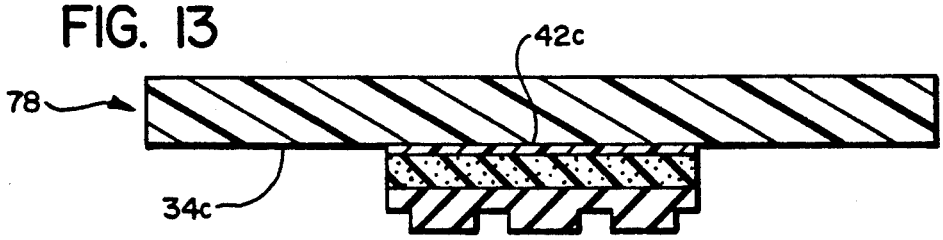
FIG. 13 is a view like FIG. 12 and of a fourth embodiment of the ink stamp.

A fourth embodiment (which is pictured in FIG. 13 and in which components which are like those in the previous embodiments are given the same numerical designations but with a suffix using small letter "c") is like the third embodiment, except that instead of water, an agent which is an adhesive, such as a removable glue, is applied to the adhering surfaces **34*c* and 42*c***. The temporary adhesive is clear, so that it does not interfere with the see-through characteristic of the handle.

9. Benefits of the Described Combination

To summarize so far, the description has explained the detachability by various means of the dies to the handle, and also the ability of the user to see through the handle, notwithstanding the fact that the dies themselves may be made of opaque natural rubber.

The detachability of the dies makes it possible for the user to employ many different dies with a single handle 16. Thus, it becomes possible for the user who collects or stocks many different printing dies to own a single handle. It is estimated that this will substantially reduce the cost of using the ink stamps.

Additionally, the see-through capability of the handle 16 enables the user to accurately position the image which is about to be printed on the paper. This feature is particularly useful with multiple images that interrelate with one another on the page (such as the letter images, and the images of the tumbling bears given as examples above).

As explained, the design of the handle and the dies permits various combinations of dies to be used, and the dies themselves may be made of the natural rubber. Tn practice, this combination of features provides a convenient and versatile stamping tool.

10. Further Details Of The Invention

Having described the major features of the invention, further details will now be provided. Thus details will concern:

a. The die silhouettes;

b. the size of the image location markings;

c. the other details.

a. The die silhouettes

Figure 14:
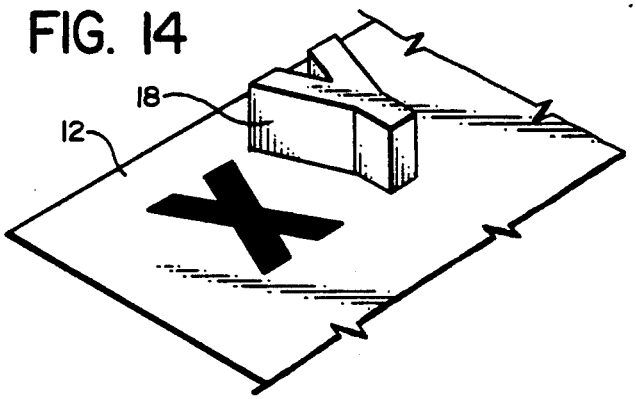
FIG. 14 illustrates in perspective a piece of paper upon which is resting an idealized printing die, the silhouette of which exactly matches the ink image produced by the die.

The person using the ink stamp 10 is of course able to see (through the transparent handle) an outline or silhouette 80 of the die 18. Preferably, the die silhouette 80 itself is shaped to give the user an indication of the location of the image. An idealized example of this is shown in FIG. 14 in which the entire die 18 is shaped with the silhouette of the image of the die, which in the pictured case is the letter 'Y'. By viewing the die silhouette 80 through the transparent handle 16, the person is able to relate the position of the image to be made to markings previously made on the paper 12 which the person is also able to see through the handle 16. The person is then able to tell where the printed image will be positioned.

Figure 15:
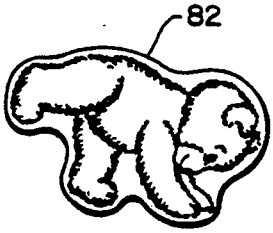
FIG. 15 illustrates a "close" die silhouette drawn around an image produced by the die.
Figure 16:
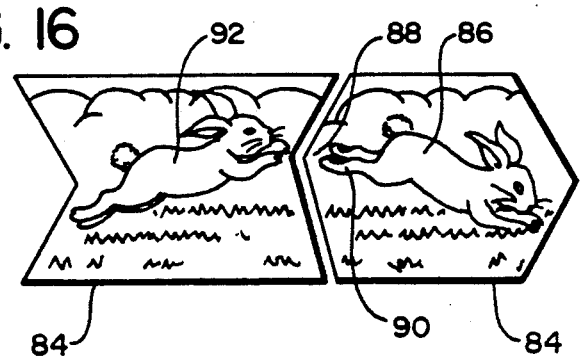
FIG. 16 is an illustration of two images, in this case jumping rabbits, made by two different dies, with "rough" silhouettes of the dies drawn around the images.

Depending upon manufacturing conditions, the die silhouettes 80 are able to be cut relatively closely to the actual image, as shown in FIG. 15 where a close silhouette 82 surrounds the image of the bear, or the die silhouette is able to be cut in a rough fashion, as shown in FIG. 16 where the two images of the rabbits produced by two different dies are surrounded by their corresponding rough die silhouettes 84. Even these rough silhouettes 84 provide assistance to the person using the see-through type of ink stamp in positioning the images in relation to one another. For example in the display shown in FIG. 16, the rough silhouette 84 for the right-hand rabbit 86 has a trailing corner 88. After comparing the position of the trailing corner 88 of the die 18 relative to a rear foot 90 of the rabbit 86, the person is able to judge the appropriate positioning of the die on the paper that will locate the righthand rabbit 86 in a visually appropriate relation to the lefthand rabbit 92.

Figure 17:
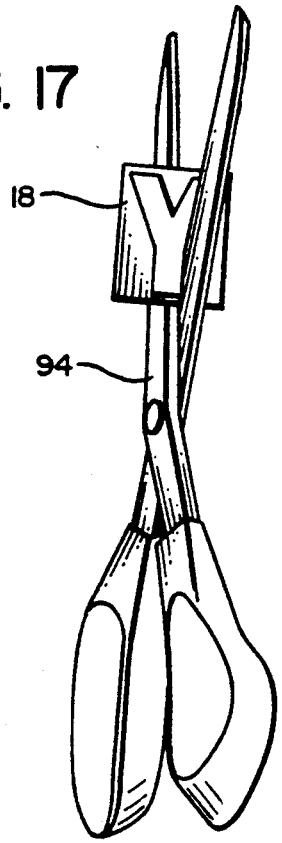
FIG. 17 illustrates a pair of household scissors being used to trim a die silhouette of the printing die.

The dies 18 are made of material that is able to be cut by ordinary household scissors 94 as shown in FIG. 17. The dies, whether closely silhouetted or roughly silhouetted form the manufacturer, may be trimmed further by the consumer using the scissors 94. The consumer can then custom cut the silhouette as desired.

b. The Details of Construction

As shown in FIG. 21 each die 18 comprises three layers. Lowermost is an imaging layer, 96 which is made of a material such the natural rubber and which contains both the protruding portions 20 for carrying the ink and the recessed portions 26. In the middle is a backing layer 98, which is preferably made of a foam material. Uppermost is a rubber magnetized mat 98 comprising magnetized particles, so that the magnetic mat 100 functions as the magnet 30 as described previously. Together these three layers make the die 18 sufficiently rigid so that it is stable against shearing forces and other stresses that would normally occur during use. However, the die material is sufficiently thin and flexible, so that, as mentioned, the material is able to be cut with household scissors. In terms of thickness the lowermost imaging layer 98 is preferably perhaps 0.105 in., the backing layer 98 is preferably 0.125 in., and the magnetic mat 100 is preferably 0.030 in.

Figure 8:
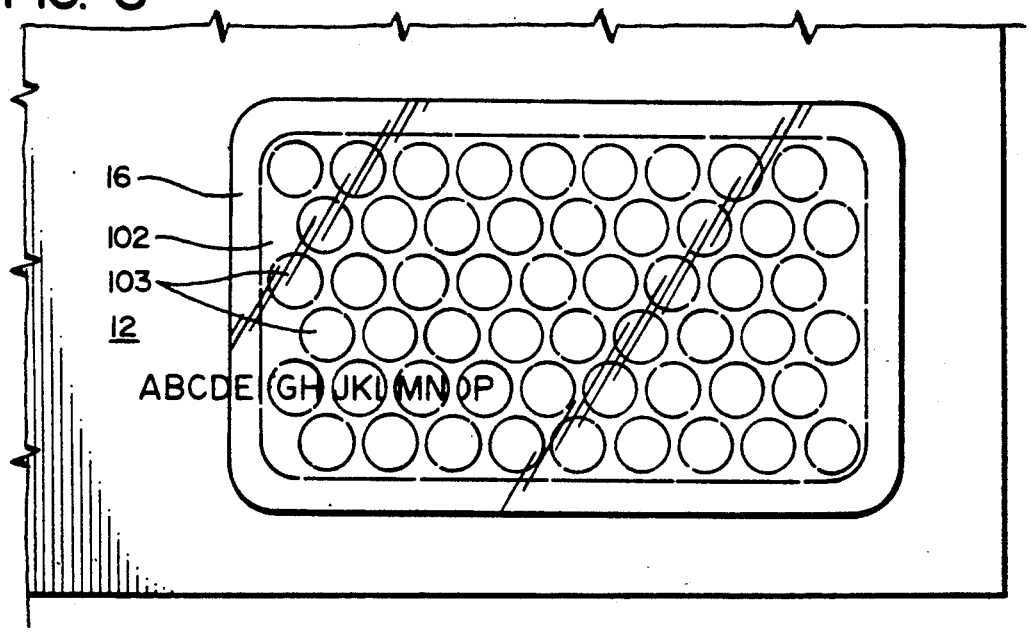
FIG. 8 is a view like FIG. 7, but illustrating a different arrangement of an iron screen which is inlaid into the handle.

As an alternative to the grid configuration of the iron screen 32 in FIG. 7, FIG. 8 shows a modified iron screen 102 comprising a thin sheet into which are cut regularly spaced, relatively large circular holes 104. As with the earlier described grid configuration of the iron screen 32, the modified iron screen 102 provides holes that are large enough for the user to see through easily.

The handle 16, as best shown in FIG. 1, is configured basically as a rectangular prism with flat, parallel top and bottom faces, i.e., the lower surface 34 and a top surface 106. The thickness of the handle as indicated by an arrow 108 is 0.375 in. (preferably a length and a width of the handle 16 approximately the actual length and wide pictured in the figures herein. It has been found that approximately this configuration and size of the handle 16 is easy for a person to grip.

In the third embodiment, the bonding surfaces may be modified to be made of resilient material and to actually contain little suction cups—to enhance adhesion.

As alternative "second materials" to the hand held stretch film (of the second embodiment) which adheres to acrylic plexiglass vinyl sheet film may be used or closed cell foams (such as are used in bathtub toys may be used).

c. Other Details

As is obvious, the magnetic means of the first embodiment 28 may be rearranged, as for example by placing the magnet 30 in the handle and placing the iron in the die 18. The concept in the fourth embodiment 78 of using a temporary adhesive to bond the die to the handle need not be combined with any use of particularly adhesive material to constitute the "bonding" surfaces. Relatively nonadhesive surfaces could be employed to which the temporary adhesive is applied.

The ability to put multiple dies on the handle at once enables different colors of ink to be used on the different dies.

Figure 12A:
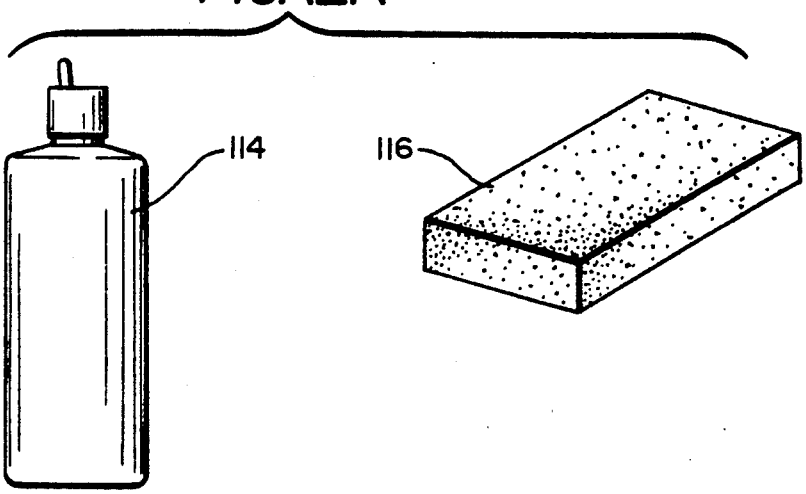
FIG. 12A illustrates a water bottle and a sponge that are used to wet the bonding surfaces of the third embodiment.

FIG. 12A shows a water bottle 114 and a sponge 116 used with the third embodiment.

It is to be understood that various modifications may be made of the foregoing description of the preferred embodiment without departing from the basic teachings of the invention.

What is claimed is:

1. An apparatus for stamping ink images on image carrying material, comprising:

a. a substantially transparent handle having at least one substantially rigid and planar surface;

b. at least one printing die of arbitrary size and shape having a printing surface and a second surface opposite the printing surface, where means for holding ink in a pattern are formed on each printing surface; and c. reusable attachment means by which said printing die is able to be manually attached to, manually detached from, and manually reattached to said planar surface of said handle without substantially degrading: (a) the printing die; and (b) the ability of the attachment means to detach and reattach the printing die, where the attachment means further attaches the printing die to the handle in a manner that allows an end user to adjust said printing die in an unlimited number of arbitrary orientations relative to said handle, where the attaching means comprises magnetic substance imbedded in one of the printing die and the handle and a magnetically attractable substance imbedded in the other of the printing die and handle; wherein both (i) a substantial portion of the second surface on the printing die; and (ii) at least a portion of the image carrying member are visible through the handle.

2. An apparatus as recited in claim 1, in which the magnetically attractable substance is a metal wire imbedded in the handle in a cross-hatched pattern.

3. An apparatus as described in claim 1, further comprising means formed on the printing dies for indicating an orientation of the patterns formed by each of the ink holding means, where the attachment means are formed to allow at least part of the indicating means to be visible through the handle.

4. An apparatus as described in claim 3, in which the attachment means and handle are so formed that the orientation of the indicating means relative to the image carrying material is visible therethrough.

5. An apparatus as described in claim 3, in which the indicating means comprises an indexing portion corresponding to and aligned with the pattern formed by the ink holding means, wherein the indexing pattern is formed on the second surface of the printing die.

6. An apparatus as described in claim 3, in which the indicating means comprises an indexing silhouette corresponding to and aligned with an outline of the pattern formed by the ink holding means, where the die is formed in the shape of the indexing silhouette.

7. A method of forming an an artistic ink image on image carrying material, comprising:

a. providing a substantially transparent handle;

b. providing a first group of at least one printing die of various sizes and shapes, where each printing die has a printing surface and a second surface opposite the printing surface, where means for holding ink in a pattern corresponding to the ink image are formed on the printing surface;

c. providing attachment means for allowing printing dies to be selectively attached to, detached from, and adjusted on the second surface by an end user in an unlimited number of arbitrary orientations with respect to the handle without substantially degrading: (a) the printing die; and (b) the ability of the attachment means to detach and reattach the printing die;

d. forming indicating means on each printing die for indicating an orientation of the ink holding means on the printing surface thereof;

e. attaching the second surface of each printing die in the first group to the handle with the attaching means in a first arbitrary orientation with respect to the handle;

f. applying ink to the ink holding means of each die in the first group of at least one die; and g. so adjusting the first group of at least one printing die while viewing the indicating means and image carrying material through the handle that the patterns formed by the ink holding means are placed in a desired orientation with respect to the image carrying material;

h. bringing the first group of at least one printing die in contact with the image carrying material so that the ink holding means transfers a first ink image thereto.

8. A method as recited in claim 7, further comprising the steps of:

a. providing a second group of at least one printing die of various sizes and shapes, where each printing die has a printing surface and a second surface opposite the printing surface, where means for holding ink in a pattern corresponding to the ink images are formed on the printing surface;

e. attaching the second surface of each printing die in the second group to the handle with the attaching means in a second arbitrary orientation with respect to the handle;

f. applying ink to the ink holding means of each die in the second group of at least one die; and g. so adjusting the second group of at least one printing die and transparent handle while viewing the indicating mans and image carrying material through the handle that the patterns formed by the ink holding means are placed in a desired orientation with respect to the first image on the image carrying material;

h. bringing the second group of at least one printing die in contact with the image carrying material so that the ink holding means transfers a second ink image thereto to form a composite ink image with the first ink image.

9. An apparatus for stamping ink images on image carrying material, comprising:

a. a substantially transparent handle having at least one substantial rigid and planar surface;

b. at least one printing die of arbitrary size and shape having a printing surface and a second surface opposite the printing surface, where means for holding ink in a pattern are formed on each printing surface; and c. reusable attachment means by which said printing die is able to be manually attached to, manually detached from, and manually reattached to said planar surface of said handle without substantially degrading: (a) the printing die; and (b) the ability of the attachment means to detach and reattach the printing die, where the attachment means further attaches the printing die to the handle in a manner that allows an end user to adjust said printing die in an unlimited number of arbitrary orientations relative to said handle, where the attachment means comprises an adhesive layer formed on the second surface of the dies, and where the adhesive layer allows the end user to manually attach the dies to the handle and manually detach the dies from the handle in a manner that allows adjustment of the dies on the handle; wherein both: (i) a substantial portion of the second surface on the printing die; and (ii) at least a portion of the image carrying member are visible through the handle.

10. An apparatus for stamping ink image on image carrying material, comprising:

a. a substantially transparent handle having at least one substantially rigid and planar surface;

b. at least one printing die of arbitrary size and shape having a printing surface and a second surface opposite the printing surface, where means for holding ink in a pattern are formed on each printing surface; and c. reusable attachment means by which said printing die is able to be manually attached to, manually detached from, and manually reattached to said planar surface of said handle without substantially degrading: (a) the printing die; and (b) the ability of the attachment means to detach and reattach the printing die, where the attachment means further attaches the printing die to the handle in a manner that allows an end user to adjust said printing die in an unlimited number of arbitrary orientations relative to said handle, where the attachment means comprises: magnetic material formed in the printing dies; and magnetically attractable material imbedded in a pattern in the handle, the die being attached to the handle by the attraction of the magnetically attractable material to the magnetic material, and the pattern allowing the end user to view a substantial portion of the die through the handle; wherein both: (i) a substantial portion of the second surface on the printing die; and (ii) at least a portion of the image carrying member are visible through the handle.

* * * * *